US008714651B2

(12) United States Patent
Cassaday

(10) Patent No.: US 8,714,651 B2
(45) Date of Patent: May 6, 2014

(54) ROTATABLE ARMREST

(76) Inventor: Terry Cassaday, Mississauga (CA)

( * ) Notice: Subject to any disclaimer, the term of this patent is extended or adjusted under 35 U.S.C. 154(b) by 0 days.

(21) Appl. No.: 13/563,823

(22) Filed: Aug. 1, 2012

(65) Prior Publication Data

US 2012/0292974 A1 Nov. 22, 2012

Related U.S. Application Data

(62) Division of application No. 11/966,210, filed on Dec. 28, 2007, now abandoned.

(51) Int. Cl.
*A47C 1/03* (2006.01)

(52) U.S. Cl.
USPC ..... 297/411.35

(58) Field of Classification Search
USPC ..... 297/291, 292, 332, 333, 411.35
See application file for complete search history.

(56) References Cited

U.S. PATENT DOCUMENTS

| | | | | |
|---|---|---|---|---|
| 3,586,355 | A * | 6/1971 | Magi | 403/91 |
| 3,690,726 | A * | 9/1972 | Van Ryn | 297/332 |
| 5,601,335 | A * | 2/1997 | Woods et al. | 297/301.3 |
| 5,746,480 | A * | 5/1998 | Bonutti | 297/411.35 |
| 5,749,628 | A * | 5/1998 | Synder et al. | 297/411.36 |
| 6,106,070 | A * | 8/2000 | Ritt et al. | 297/411.35 |
| 6,460,932 | B1 * | 10/2002 | Kopish et al. | 297/411.36 |
| 7,367,627 | B2 * | 5/2008 | Figueras Mitjans | 297/411.2 |
| 2002/0043862 | A1 * | 4/2002 | Piretti | 297/411.35 |

* cited by examiner

*Primary Examiner* — Peter Brown
(74) *Attorney, Agent, or Firm* — Eugene J. Gierczak

(57) ABSTRACT

An armrest for a chair having a first member connected to the chair; a second member selectively rotatable relative the first member; means disposed between the first and second members for resisting the rotational movement between the first and second members.

13 Claims, 5 Drawing Sheets

ROTATABLE ARMREST

This application is a divisional of U.S. application Ser. No. 11/966,210 filed Dec. 28, 2007.

FIELD OF INVENTION

This invention relates to rotatable armrests and particularly relates to an armrest for a chair having a first member connected to the chair, a second member selectively rotatable relative to the first member and structure disposed between the first and second members for resisting the rotational movement between the first and second members. A method of resisting the rotational movement of an armrest is also shown.

BACKGROUND TO THE INVENTION

A pair of armrests are often associated with chairs to provide support for a users forearms while working despite the differences in sizes, shapes and preferences of users. This is particularly important for individuals having desk jobs where persons may stay seated for long periods of time and where different users use the same chair. It is also important for users that are different in size to be able to adjust the armrests to a lateral position that is comfortable for them. In this regard it is common for armrests to be selectively rotatable about a vertical axis.

For example, U.S. Pat. No. 5,769,496 relates to an adjustable arm apparatus including a lateral shaft having a stop member, an armrest frame rotatably mounted on the shaft allowing limited rotation and an actuator to act on the stop member to adjust the positioning and degree of rotation of the frame about the shaft.

Moreover, U.S. app. no. 2002/0070598 shows a swivel armrest providing the pivoting armrest to allow multi-position adjustment.

Furthermore U.S. Pat. No. 6,168,237 teaches an armrest construction for chairs which includes an armrest support having a lower end constructed for attachment to a chair, an upper end and a pivoting block attached to the upper end.

Furthermore U.S. Pat. No. 7,029,049 teaches an adjustable armrest and a method of inhibiting the movement of an armrest.

Finally, U.S. Pat. No. 6,948,775 relates to an armrest which includes a support rod, a base, a locating seat, a mounting seat and an upper cover wherein the base has a chamber having at least one guide rail, each provided with engagement grooves.

These and other prior art armrests present relatively complicated structures.

Furthermore it is not uncommon for a user to apply their weight against the armrests as the user rises from the chair. One of the difficulties experienced by prior art armrests resides in the instability which is exhibited during the application of force against the armrests when the user rises. It is not uncommon for these rotatable armrests to "give" and rotate unnecessarily during this action which can cause the user instability while rising.

In other words it is not uncommon for these armrests to rotate laterally outwardly from the chair, causing the users arms to move outwardly while rising. In other words, the rotatable armrests tend to laterally rotate about a vertical access of rotation.

Accordingly, there is a need to provide rotatable armrests which inhibit unwanted rotation while at the same time permitting rotation when the user is seated.

DISCLOSURE OF INVENTION

Accordingly it is an aspect of this invention to provide an, armrest for a chair having a first member connected to the chair; a second member selectively rotatable relative to the first member; and structure disposed between the first and second members for resisting the rotational movement between the first and second members.

In one aspect of this invention the first and Second members include low density plastic material which resists movement therebetween. In a further embodiment, high density plastic material is provided between the first and second members to permit selective rotational movement between the first and second members at selected intervals.

It is another aspect of this invention to provide damper structure between the first and second members for resisting rotational movement of the first member relative to the second member about an axis of rotation. In one embodiment of the invention the damper structure comprises a torque resistor disposed about the axis of rotation. The torque resistor can comprise a first portion which is engageable with the first member and a second portion which is engageable with the second member and a shaft disposed between the first and second portions of the torque resistor.

It is also an aspect of this invention to provide a method of rotating an armrest about a vertical support connected to a chair which comprises disposing a torque resistor structure between the vertical support and the armrest for resisting rotational movement about the axis of rotation when the armrest is pushed against the vertical support and for permitting the rotation of the armrest relative to the vertical support beyond the selected level.

These and other objects and features of the invention shall now be described in relation to the following drawings.

BEST MODE FOR CARRYING OUT THE INVENTION

Figure 1:
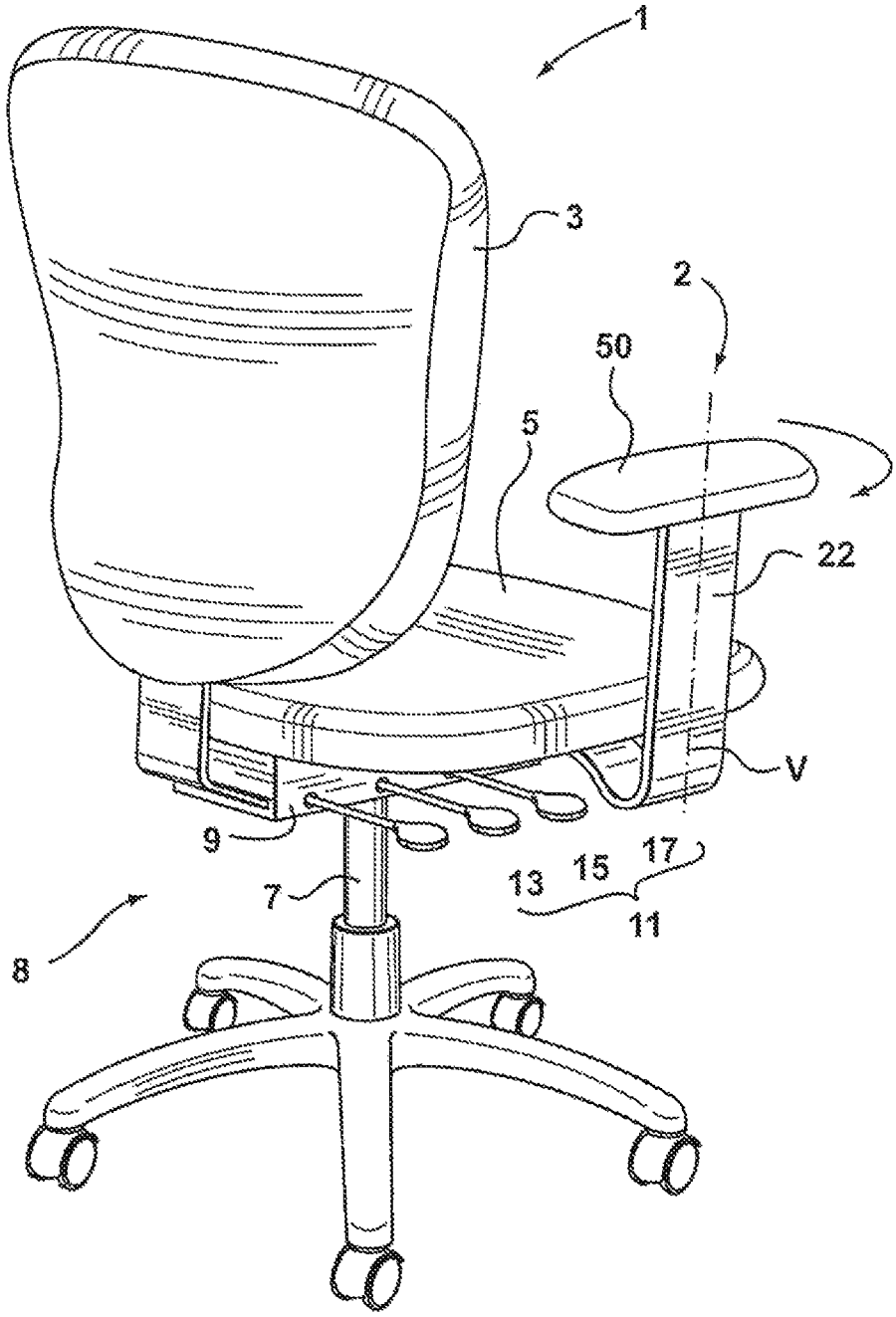
FIG. 1 is a representative drawing of a chair having an armrest.

In the description which follows, like parts are marked throughout the specification and the drawings with the same respective reference numerals. The drawings are not necessarily to scale and in some instances proportions may have been exaggerated in order to more clearly depict certain features of the invention.

FIG. 1 illustrates a typical chair 1 having a backrest 3 and a seat 5. Furthermore the chair 1 can include adjustment means 9 which comprise of adjustment structure 7 having adjustment levers 11 which are individually numbered 13, 15 and 17 so as to adjust the chair in a manner well know to those persons skilled in the art.

The chair also includes a pedestal 7.

The armrest 2 comprises of a first member 22 connected to the chair and a second member 50 which is selectively rotatable relative to the first member 22 about the vertical axis V.

Means 45 is disposed between the first member 22 and second member 50 for resisting the rotational movement between the first and second members.

In one embodiment of the invention the means 45 for resisting the rotational movement between the first 22 and second 50 members comprises:

(a) one of the first 22 and second 50 members including low density plastic material;

(b) first and second plates 30 and 40.

Figure 2:
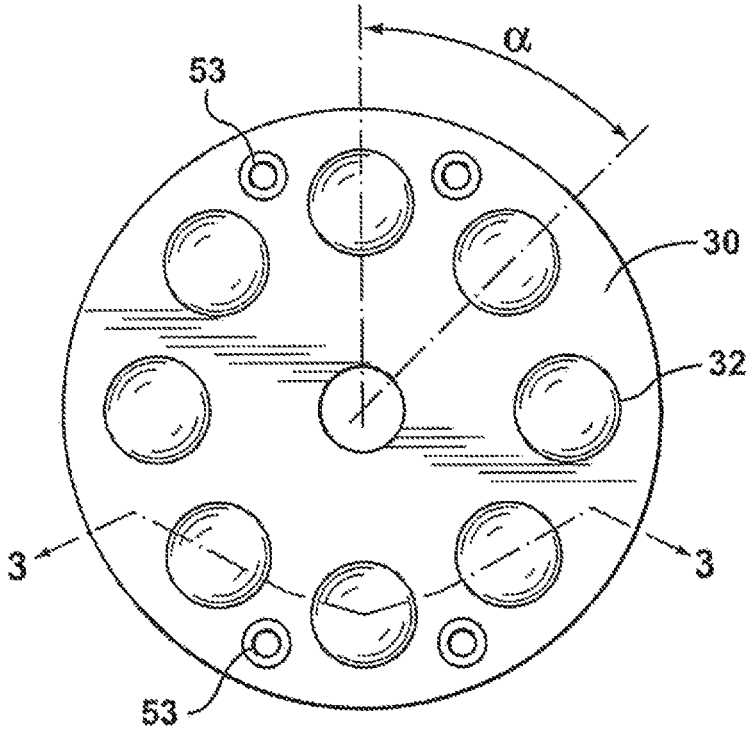
FIG. 2 is a top plan view of a first plate having spaced projections.

FIG. 2 illustrates a first plate 30 having spaced projections 32. In the embodiment shown in FIGS. 2 and 3 the spaced projections are equally disposed radially about an angle a as shown. Any number of projections 32 can be utilized. The first plate 30 can be secured to the first member 22 in any number of ways including fastening means, adhesive or other means.

Figure 4:
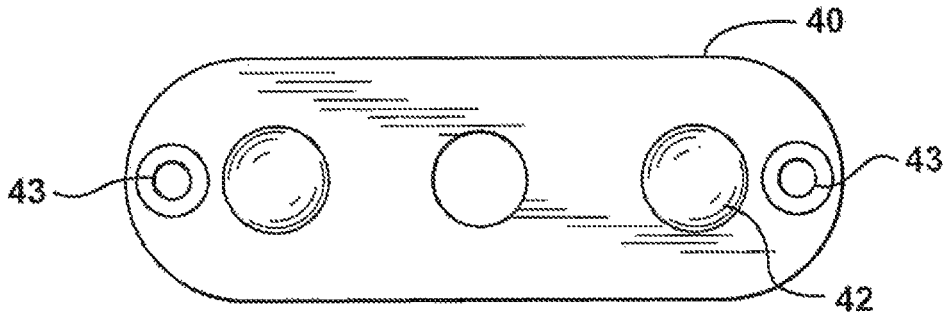
FIG. 4 is a top plan view of a second plate having-spaced depressions for receiving the spaced projections of the first plate.
Figure 5:
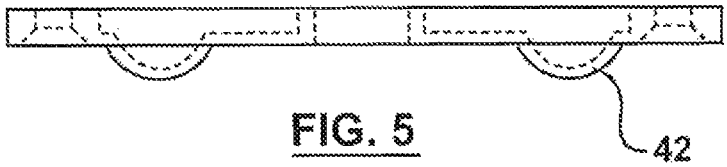
FIG. 5 is a side view of FIG. 4.
Figure 6:
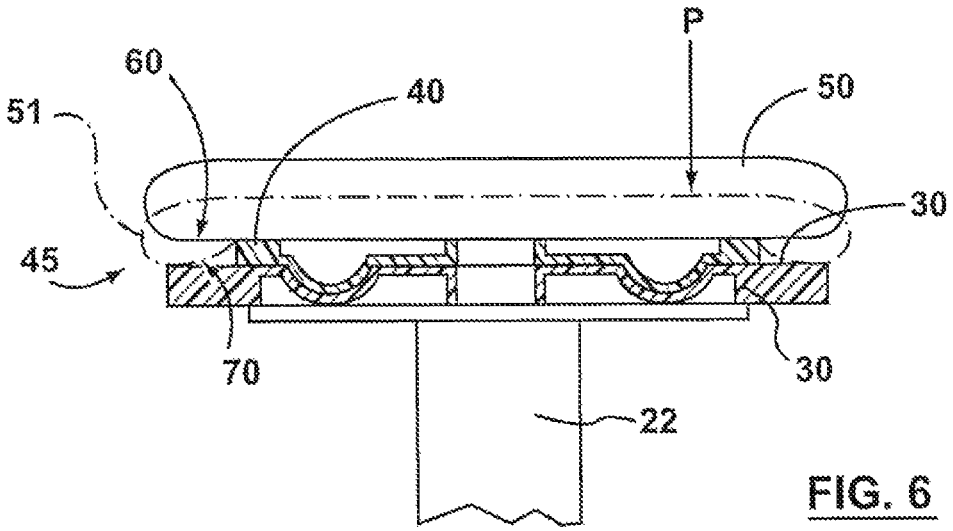
FIG. 6 is a partial cross-sectional view of one embodiment of the invention.

FIGS. 4 and 5 illustrate an embodiment of the second plate 40 which includes a plurality of recesses 42 adapted to receive the projections 32 when the second plate 40 is superimposed about an axis of rotation V as shown in the drawings. The second plate 40 is secured to the underside, of the second member or armrest 50 as best illustrated in FIG. 6. In another embodiment, first plate 30 can be associated with second member 50 and second plate 40 can be associated with first member 22.

Figure 3:
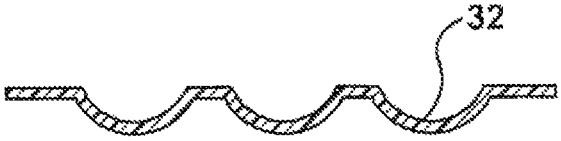
FIG. 3 is a side view of FIG. 2.

FIG. 6 illustrates one embodiment of the invention whereby the second member or armrest 50 comprises of low density plastic material which is deformable when pressure P is applied thereto. The deformability of second member or armrest 50 is shown by the hidden lines of FIG. 6. Accordingly the hidden lines of FIG. 6 illustrate the deformability of the second member when a user rises from the chair thereby applying the user's weight by pressure P so as to deform the second member. When the second member 50 which comprises of soft plastic material deforms, the low density plastic material pushes against the upper surface 31 of the first plate 30 as shown. The first and second plates 30 and 40 respectively comprise of a harder material which is generally not deformable upon the application of pressure P. Accordingly the soft or low density plastic material is pushed against the high density material 30 therefore the armrests 50 tends to "grip" and resist rotation R under this condition. The low density plastic material deforms beyond the exterior extent of the second plate 40 as shown in FIG. 3. The first and second plates can be comprises of any number of materials including metal or high density plastic material.

When a user is in a chair, the low density plastic material moves from the dotted lines shown in FIG. 6 to the solid lines shown in FIG. 6 thereby permitting rotation of the second plate 40 relative to the first plate 30, or in other words the second member or armrest 50 relative to the first member 22. Since the first plate 30 includes projections 32 relative to the second plate 40 a user is able to selectively rotate the armrest 50 relative to the first member 22 so that the projections 32 sequentially move into the recesses 42 at selective intervals at an angle a in a detent fashion. Accordingly the projections 32 and recesses 42 illustrate detent means so that the user is able to rotate the armrest laterally about the vertical axis V at selected intervals defined by angle a.

The radial extent of the second plate 40 is smaller than the radial extent of the first plate 30 as shown in FIG. 3 so as to provide a region for the extremities 51 of second member 50 to deform and contact the upper surface 31 of the first plate 30 as shown.

Figure 7:
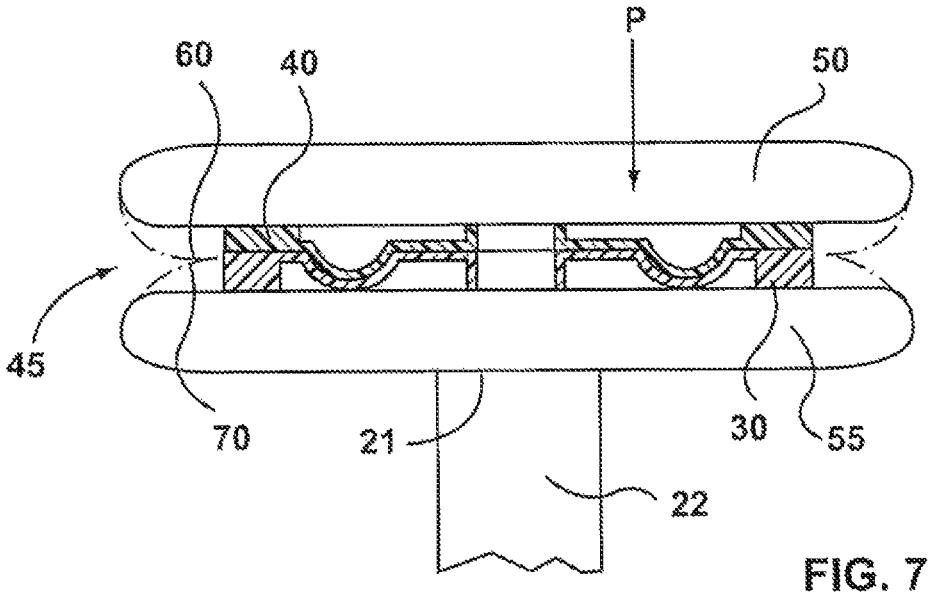
FIG. 7 is a partial cross-sectional view of another embodiment of the invention.

FIG. 7 shows another embodiment of the invention whereby the radial extent of both the first and second plates 30 and 40 are substantially the same. However, the first member 22 also includes at its upper end 21 a lower armrest 55 which is connected to the first support member 22 by any number of means including fastening, gluing, welding or the like. The lower armrest member 55 includes the first plate 30 which is connected thereto by means of fasteners that are adapted to be received by the holes 53 and secured thereto. The upper armrest member 50 also includes a second plate 40 which is secured thereto by any number of means including fasteners which are adapted to be secured through the holes 43. The first and second plates 30 and 40 comprise of a material which is substantially non-deformable such as metal or high density plastic material. The upper and lower armrest portions 50 and 55 comprise low density material which is deformable as shown by the hidden lines. Accordingly upon the application of pressure P when a user pushes down on the armrests when rising from the chair the upper and lower low density plastic material will deform as shown causing the upper and lower armrest portions 56 and 55 "grip" one another substantially resisting rotation of the armrests in this position.

During resting of the user in the chair pressure P is alleviated causing the deformable portions of the upper and lower armrests 50 and 55 to relax and move back to the original position as shown by the solid lines of FIG. 5; thereby permitting rotation of the upper armrest portion 50 relative to the lower portion 55 as previously described.

Figure 8:
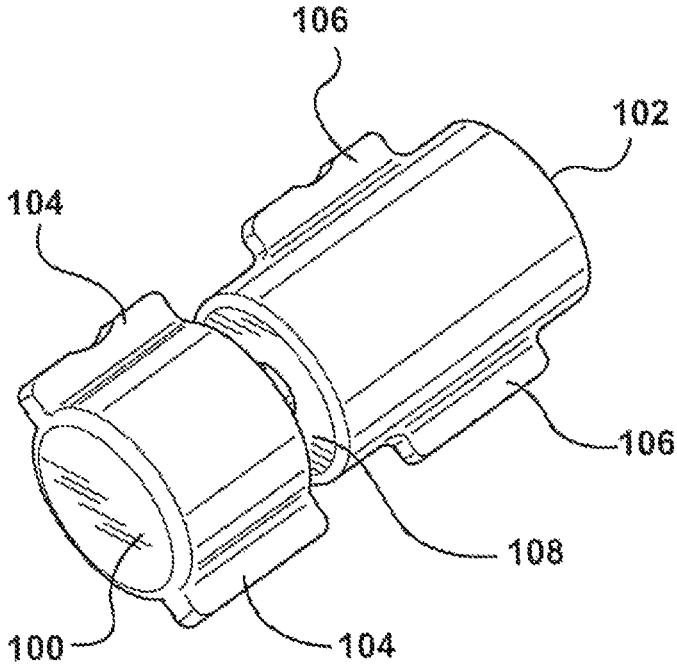
FIG. 8 is a perspective view of a torque resistor.
Figure 9:
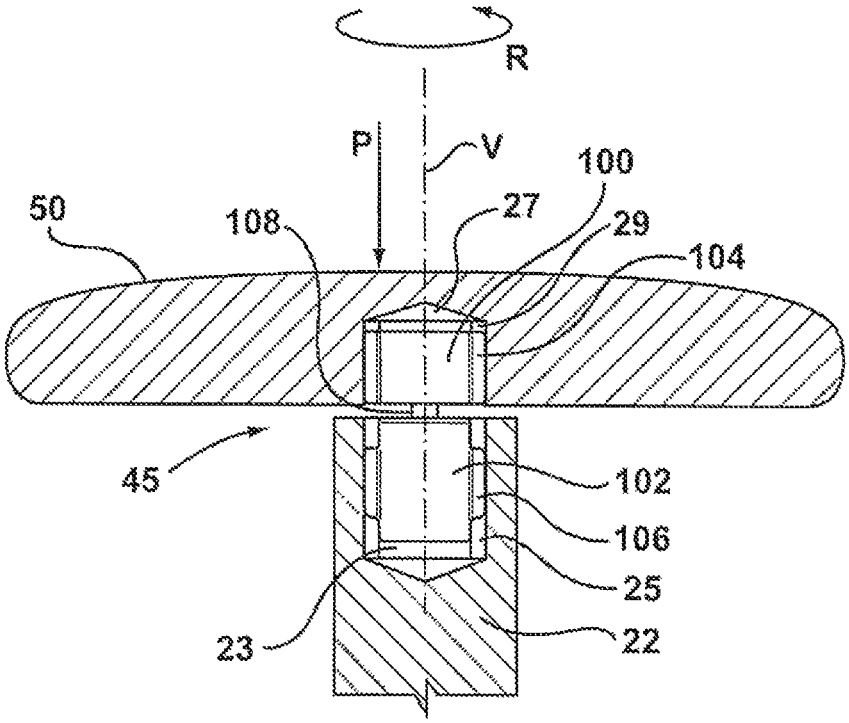
FIG. 9 is a partial cross-sectional view of the armrest assembly showing the torque resistor in place.

FIGS. 8 and 9 illustrate another embodiment of the invention whereby the means for resisting rotational movement 45 is disposed between the first and second members 22 and 50 for resisting the rotational movement between the first and second members 22 and 50 comprise damper means. The damper means comprise a torque resistor disposed about an axis of rotation V which are generally available in the marketplace. For example, a hinged damper is available from Illinois Tool Inc. as Delpro part number 43-005033. Furthermore Reel Precision Manufacturing Corporation of St. Paul, Minn. sell frictional torque restrictors or hinges with the designation T1220 frictional torque hinge. Other torque restrictors are also available.

The torque restrictor illustrated in FIG. 8 comprises a first torque portion 102 and a second torque portion 100 which are rotatable relative to one another about the shaft 108 in a manner well known to those persons skilled in the art. The first torque portion 102 includes a pair or wings 106 or projections extending outwardly therefrom while the second torque portion 100 includes a second pair of wings or projections 104 as shown.

The first member 22 includes a hole or bore 23 for receiving the first torque portion 102 as shown. Moreover the bore or hole 23 also includes a plurality of slots 25 which are adapted to receive the wings 106 so as to fixedly retain the first portion 102 relative to the first member 22.

Moreover the second member or armrest 50 also includes a second hole or bore 27 which is adapted to receive the second torque portion 100 as shown. The second hole or bore 27 also includes a plurality of slots 29 which are adapted to receive the wings 104 so as to fixedly retain the second torque portion 100 relative to the second member or armrest 50 as shown. The second member or armrest 50 in the embodiment shown in FIG. 5 can comprise of a non-deformable material such as high density plastic material so as to fixedly secure the torque restrictor even under the application of pressure P. Accordingly, in the embodiment shown in FIG. 9 a user can selectively rotate the second member or armrest 50 about arc R as shown upon the application of lateral force. The torque restrictor is selected so as to resist rotation of the armrest 50 at a selected level. Accordingly the armrest will not move even when a user is in a seated position until sufficient force is applied to the second member or armrest 50 beyond the selected level of torque resistance so as to permit rotation of the second member 50 about the first member 22. Accordingly when a user raises the second member or armrest 50 will tend to resist the rotation of the armrest thereby providing better stability during this operation.

Furthermore the torque resistor provides a circumferential resistance or radial resistance to rotation (rather than axial) which exhibits little backlash or springback and holds the position in a desired location. Furthermore the resistors do not loosen appreciatively over time and provide a substantially constant torque over time. Moreover the torque resistors offer excellent resistance to the wanted rotation of the second member 50 relative to the first member 22 when a sudden force is applied thereby exhibiting excellent resistance to rotation. However, upon the application of a slow or constant force a user seated in the chair is able to rotate the armrest 50 to a desired position.

FIG. 9 therefore discloses a method of rotating an armrest about a vertical support connected to a chair comprising disposing a torque resistor between the vertical support and the armrest for resisting rotational movement about the axis of rotation when the armrest is pushed against the vertical support and for permitting the rotation of the armrest relative to the vertical support beyond the selected level.

Moreover the earlier embodiments described above also include a method of rotating an armrest about a vertical support connected to a chair which comprises utilizing low density plastic material and high density plastic material between the vertical support and the armrest for resisting rotational movement about the axis of rotation when the armrest is pushed against the vertical support and from permitting the rotation of the armrest relative to the vertical support beyond the selected level.

It should be appreciated that the torque resistor as described herein can also be utilized in combination with the first embodiments described herein so as to provide excellent resistance to the undesirable rotation of the armrest about a vertical support.

Moreover it is possible to utilize different strengths of torque resistors in each of the arms 50 which accompany a chair.

Various embodiments of the invention have now been described in detail. Since changes in and/or additions to the above-described best mode may be made without departing from the nature, spirit or scope of the invention, the invention is not to be limited to said details.

I claim:

1. An armrest for a chair having:

(a) a first member connected to the chair;

(b) a second member selectively rotatable relative the first member, (c) a hinge damper disposed between the first and second members for resisting the rotational movement between the first and second members, about a vertical axis of rotation;

(d) wherein the hinge damper comprises a first portion engageable with the first member and a second portion engageable with the second member, and a torque resistor shaft disposed between the first and second portions;

(e) wherein the first member has a first recess for receiving the first portion;

(f) wherein the second member has a second recess for receiving the second portion.

2. An armrest as claimed in claim 1 wherein one of the first and second members include low density plastic material resisting movement therebetween.

3. An armrest as claimed in claim 2, the hinge damper is disposed between the low density plastic material for permitting selective rotational movement between the first and second members and wherein the low density plastic material of the first member is spaced from the low density material of the second member in a first position for permitting selective rotational movement and wherein the low density plastic material of the first member contacts the low density plastic material of the second member in a second position for resisting rotational movement between the first and second members.

4. An armrest as claimed in claim 3 wherein the second member comprises a padded upper armrest rotatable about said vertical axis of rotation.

5. An armrest as claimed in claim 4 wherein the first member has an upper end and comprises a padded armrest at the upper end rotatable about the vertical axis of rotation.

6. An armrest as claimed in claim 5 wherein the first member is attached to the chair at the lower end of the first member.

7. An armrest as claimed in claim 1 wherein said hinge damper resists rotational movement of the first member relative to the second member about said vertical axis of rotation.

8. An armrest as claimed in claim 1 wherein each of the first and second portions include at least one wing and each recess includes at least one slot for receiving the wings of the first and second portions.

9. An armrest for a chair having:

(a) a first member connected to the chair;

(b) a second member selectively rotatable relative the first member;

(c) a torque resistor disposed between the first and second members for resisting the rotational movement between the first and second members, about a vertical axis of rotation;

(d) wherein one of the first and second members include low density plastic material resisting movement therebetween;

(e) wherein said hinge damper resists rotational movement of the first member relative to the second member about said vertical axis of rotation;

(f) wherein the torque resistor comprises a first portion engageable with the first member and a second portion engageable with the second member, and a shaft disposed between the first and second portions;

(g) wherein the second member comprises an armrest having a recess for receiving the second portion;

(h) wherein the first member has a recess for receiving the first portion;

(i) wherein each of the first and second portions includes wings and each recess includes slots for receiving the wings of the first and second portions.

10. An armrest as claimed in claim 9 wherein the strength of the torque resistor is selected to resist rotational movement at a selected level when the first member is pushed against the second member.

11. A method of rotating an armrest about a vertical support connected to a chair comprising:

(a) disposing torque resistor means between the support and the armrest for resisting rotational movement about a vertical axis of rotation when the armrest is pushed against the support, and for permitting the rotation of the armrest relative to the support beyond a selected level where the torque resistor means has a first portion engageable with the support and a second portion engageable with the armrest, and a shaft disposed between the first and second portions, and wherein the armrest includes an armrest recess for receiving the second portion and the support includes a support recess for receiving the first portion;

(b) first engaging protrusion extending from the first portion engageable with the support recess and a second engaging protrusion engageable with the armrest recess;

(c) and wherein each said first engaging protrusion include wings and said second engaging protrusion include wings and each said support recess and armrest recess include slots for receiving the wings respectively.

12. A method as claimed in claim 11 wherein the chair includes two armrests, each having a torque member means and the strength of each torque resistor is selected for a desired resistance to rotation, about said vertical axis of rotation.

13. A method as claimed in claim 12 wherein the strength of resistance of each of said armrest is different from the other.

* * * * *